US005205221A

United States Patent [19]

Melin et al.

[11] Patent Number: 5,205,221

[45] Date of Patent: Apr. 27, 1993

[54] BOARD WITH CELLULAR STRUCTURE

[76] Inventors: Ulf Melin; Carin Melin, both of Nordhemsvagen 12, Sjalevad, Sweden, S-890 23

[21] Appl. No.: 526,673

[22] Filed: May 22, 1990

Related U.S. Application Data

[63] Continuation of Ser. No. 246,310, filed as PCT/SE87/00123, Mar. 11, 1987, published as WO87/05581, Sep. 24, 1987, abandoned.

[30] Foreign Application Priority Data

Mar. 14, 1986 [SE] Sweden ..... 8601221

[51] Int. Cl.[5] ..... B65D 19/00

[52] U.S. Cl. ..... 108/51.3; 108/901

[58] Field of Search ..... 108/51.3, 51.1, 53.1, 108/54.1, 901, 902; 428/116

[56] References Cited

U.S. PATENT DOCUMENTS

| | | | |
|---|---|---|---|
| 1,296,359 | 3/1919 | Brown | 428/116 |
| 2,991,965 | 7/1961 | Drieburg | 108/51.1 |
| 3,481,285 | 12/1969 | Yellin | 108/901 |
| 3,587,479 | 6/1971 | Geschwender | 108/51.3 |
| 3,677,200 | 7/1972 | Coccagna et al. | 108/901 |
| 3,680,495 | 8/1972 | Pike | 108/901 |
| 3,709,161 | 1/1973 | Kauffman | 108/51.1 |
| 3,814,778 | 6/1974 | Hosoda et al. | 108/901 |
| 3,982,057 | 9/1976 | Briggs et al. | 108/51.3 |
| 4,279,204 | 7/1981 | Propst | 108/53.1 |
| 4,287,836 | 9/1981 | Aoki | 108/51.1 |
| 4,331,360 | 5/1982 | Roudybush et al. | 108/901 |
| 4,428,306 | 1/1984 | Dresen et al. | 108/901 |
| 4,467,612 | 8/1984 | Weasel, Jr. | 108/901 |
| 4,606,278 | 8/1986 | Shuert | 108/901 |

FOREIGN PATENT DOCUMENTS

| | | | |
|---|---|---|---|
| 1131148 | 6/1962 | Fed. Rep. of Germany | 108/51.3 |
| 2389485 | 12/1978 | France . | |
| 959185 | 5/1964 | United Kingdom | 108/51.1 |
| 8301243 | 4/1983 | World Int. Prop. O. . | |

*Primary Examiner*—Kenneth J. Dorner
*Assistant Examiner*—Brian K. Green
*Attorney, Agent, or Firm*—Dowell & Dowell

[57] ABSTRACT

A board with cellular structure, which board has a core (10) of cells (12) located adjacent one another. The cells are on one side covered by a cover layer or a cover panel (16), whereby a surface is formed for supporting a load or constituting a supporting surface. Every cell (12) is of a resiliently yielding material, such as e.g. plastics, and is hermetically sealed against both the cover panel and at its opposite end. In this way there is formed in every cell (12) an encased air cushion which absorbs and damps shocks and load acting on the core (10) consisting of coherent cells.

4 Claims, 3 Drawing Sheets

BOARD WITH CELLULAR STRUCTURE

This application is a continuation of application Ser. No. 07/246,310, filed as PCT/SE87/00123, Mar. 11, 1987, published as WO87/05581, Sep. 24, 1987, now abandoned.

BACKGROUND OF THE INVENTION

1. Field of the Invention

The present invention concerns a board with cellular structure, which board comprises a core of cells located adjacent one another, which cells on at least one side are covered by a covering layer of panel in order to constitute a load bearing or supporting surface. Such board can be used as e.g. the load bearing surface of a pallet.

2. History of the Related Art

Pallets for storage and transport of goods must satisfy a plurality of requirements. They must be light, cheap to produce, possess great structural strength and rigidity against torque and in many cases be easy to clean and hygienic in other respects for e.g. transportation of foodstuffs.

Against this background the most usual pallets of wood have a series of drawbacks. The wood which is used must comply with many demands regarding freedom from damages, cracks, rot etc. and also have a definite moisture content during manufacture and moreover comply with severe demands on the strength of the nail joints and the like. This results in that pallets of wood become relatively complicated and expensive.

In the transport of and handling with foodstuffs, pallets of wood are unhygienic, as the wood attracts moisture and thereby causes mould. By the structure of the pallet many nooks are formed, within which dirt and germs may collect. Pallets of wood are also difficult to make and keep clean, which fact has contributed to attempts to manufacture pallets from some other, lighter, stronger and more hygienic material.

In order to eliminate the drawbacks inherent to pallets of wood one has, therefore, manufactured pallets of metal and various plastics, which proved to be deficient as to structural strength and usefulness. Attempts have been made to armour the plastic in various manners, for example by means of glass fibres or similar reinforcing materials.

This, however, involves disadvantages, because the reinforcing means make the pallet more expensive to manufacture and, in addition, increase the weight of the pallet. Another substantial problem arises also by the request that pallets of plastics after damages or wear shall be capable of becoming employed again, which is realized thereby that the pallet is ground down and re-cast. However, this treatment will be made difficult or impossible when pallets of armoured plastics are used, since the armour of glass fibres or similar material causes an unacceptable wear on the machines used for the grinding procedure.

Attempts have even been made to manufacture pallets with cellular structure for separate transports. Thus it is known from the Swedish published patent application 356,944 to manufacture a pallet from a light, cheap material such as paper, plastics or the like, wherein several separate casings of said material are disposed adjacent one another for constituting a pallet of honeycomb-like structure. The casings may herewith have cylindrical or angular shape and some casings are lengthened for serving as feet of the pallet.

There has been proposed also, e.g. according to U.S. Pat. Nos. 3,587,479, 3,709,161 and 4,319,530, to produce pallets of cardboard composed of cellular cavities, which are formed by assemblage of creased strips of cardboard.

These pallets with cellular structure have, as already mentioned, more the character of non-recurrent nature and are primarily intended for facilitating the handling by not being returned to the sender, which naturally limits the field of use, the pallet in these cases constituting part of the package of the goods.

The described pallets with cellular structure have, even if they should be produced for multiple use, several drawbacks. The structure with individual casings or assembled creased strips results in that the consumption of material becomes large and that a pallet of plastic material built up in this way and destined to endure multiple utilization obtains increased weight and, therefore, becomes expensive in manufacture and use. The application of cardboard as material for the pallet provokes, on the other hand, the same problems as wood material when the hygienic aspects are in consideration, for example. The known pallets for which cardboard or paper has been proposed as material, form due to their composition of a plurality of casings or creased layers a great number of cavities and/or nooks, within which dirt, germs etc. can accumulate.

The greatest disadvantage inherent to the pallets built up in accordance with the known art from individual casings or creased layers is, however, that they even with considerable dimensioning do not obtain nessecary strength for sustaining those strains which come up under the treatment of the pallet with or without load. Thus a strong spot load or impact against an edge or surface of the pallet will result in that the casings or cells are compressed and thereby given a permanent deformation which cannot be restored, since the wall material in the casings and possible covering layers has been cracked and cannot regain its original configuration. Therefore, as mentioned earlier, these pallets are best suited for single use and can in no way be compared with pallets of wood or cast, armoured plastics, which shall be usable repeatedly as pallets of exchange inspite of the rough treatment to which they often are subjected.

SUMMARY OF THE INVENTION

The main object of the present invention is against the background of the above to provide a board with cellular structure, which can be used as e.g. load carrying panel in a pallet for multiple use, wherein the aforementioned drawbacks inherent to known pallets made of both wood, cast plastics or with cellular structure are eliminated totally.

Another object is to provide such a board which is especially suited to be manufactured from a light and relatively cheap material and with a shape which renders it extremely utilizable in response to highly advanced hygienic demands.

The above stated and other objects are obtained thereby that the board according to the invention has been given the characteristic features stated in the following claims.

BRIEF DESCRIPTION OF THE DRAWINGS

The invention together with its advantages will be described in detail hereinafter with reference to a preferred embodiment which is shown in the accompanying drawings. Therein.

DESCRIPTION OF THE PREFERRED EMBODIMENT

Figure 1:
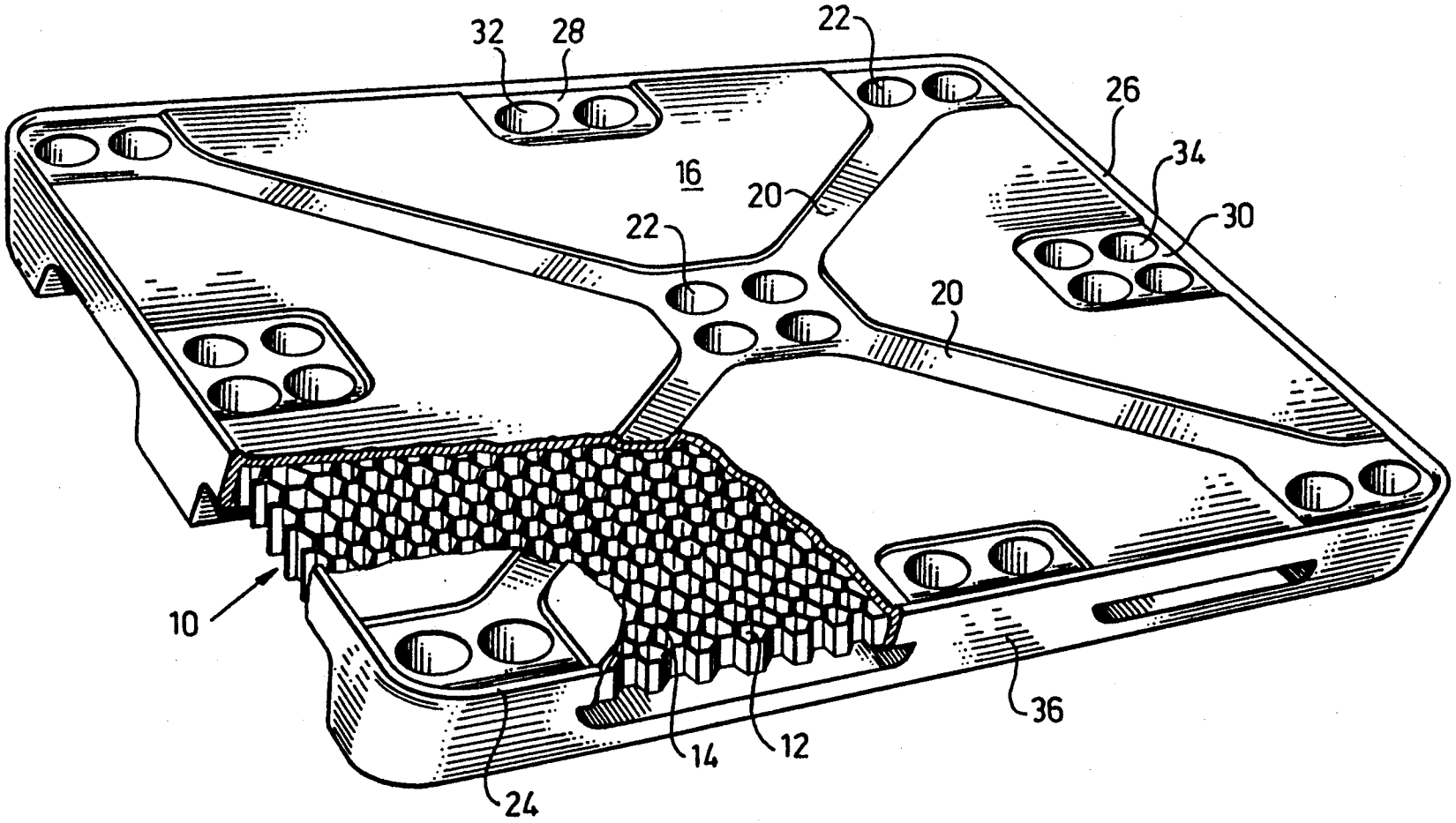
FIG. 1 shows in a perspective and partly sectioned view a pallet of plastic material, in which pallet is included a board with cellular structure according to the invention.

As is evident from FIG. 1, the shown pallet comprises a load carrying board or core 10 with cellular structure. The cells have here multiple edge shape, preferably as in the shown embodiment, hexagonal shape and form a honeycomb structure, which extends over the entire surface of the load carrying board. According to the invention, every cell 12 has walls 14 which are common, i.e. in one piece with the walls 14 of the surrounding cells. Thus, in contrast to previously known pallets or boards with cellular structure the cells are here not formed by casings or creased bands or strips, but all cells 12 are integrated to a unitary structure without any joints. According to the invention, there is further used for the load carrying board an elastic, i.e. yielding material, preferably plastics, and the cellular structure 10 manufactured from said material is provided with a cover layer 16, 18 on both the bottom side and the top side, which cover layers 16, 18 are connected to the cellular structure 10 in such a manner that every cell 12 becomes individually sealed hermetically. This joining between cover layers 16, 18 and cellular structure 10 can be effected in some suitable way, for example by glueing, welding or other melting in some manner known in the art of shaping plastic articles.

By building up the cellular structure 10 in this way from cells 12 which form a unitary structure without joints, wherein every cell 12 is shut hermeticallly and consists of a yielding material, a load carrying surface with incredible strength is obtained. Every cell functions as stay member and supporting part for the whole cellular structure 10, since the cells are integrated with each other, i.e. united into a coherent entirety, and every cell functions also, owing to the enclosed air cushion, as a shock damper and shock absorber. The enclosed air cushion and shaping of the cell structure 10 from an elastically yielding material causes also that the cellular structure 10 when subjected to shocks or spot load, is not cracked, but yields resiliently and recovers its original shape when the load disappears. The described cellular structure 10 involves also that the load carrying board obtains very high strength against twisting forces and thus is considerably more rigid against twisting than previously known constructions.

The upper cover layer 16 of the board represents preferably, as is shown in the embodiment depicted in the drawings, the upper cover of the pallet, and in this connection the top surface is formed with grooves 20, which conduct possible moisture and water formed therefrom to draining holes 22 disposed at the centre and corners of the pallet.

If necessary, the cover 16 is also, as is evident from the embodiment shown in the drawing, provided at its longitudinal and short sides with depressions 28, 30, which also are provided with draining holes 32, 34.

Arranged around the periphery of the pallet is an edge border strip 24 which seals the cellular structure 10 along the sides and is fixed thereto by means of glueing, welding or similar jointing means, preferably the same which are used for securing the cover 16 to the cellular structure 10. The edge strip 24 projects a bit, such as by 5 mms for example, over the cover 16 and constitutes hereby an all around extending list 26. This list 26 makes the pallet well adapted for piling without any risk that the piles of pallets should come down. The list 26 involves also that goods not so easily slide away from the pallet.

Figure 2:
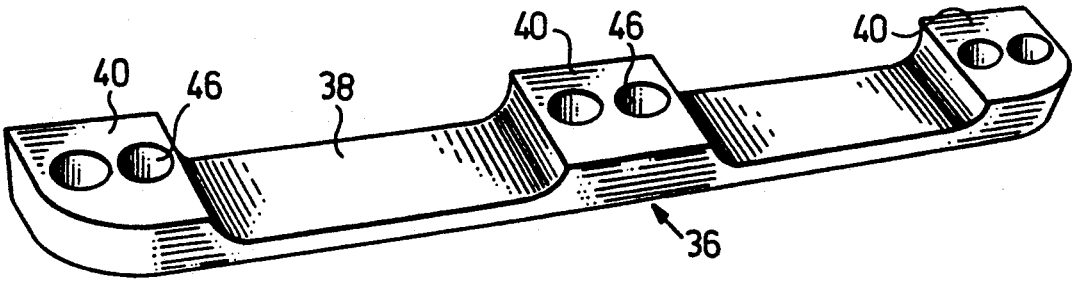
FIG. 2 shows in a perspective view a bottom part which is an integral part and acts as support member in the pallet according to FIG. 1.
Figure 3:
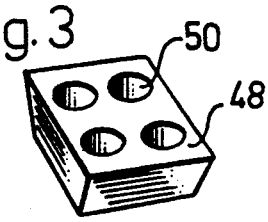
FIG. 3 shows in a perspective view another shape of a support member for the pallet of FIG. 1.
Figure 4:
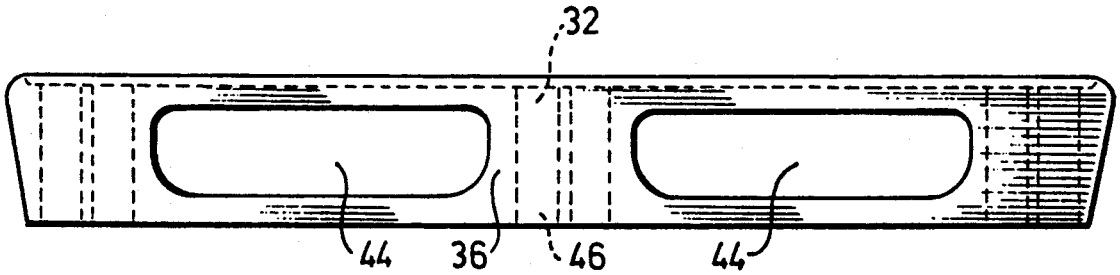
FIG. 4 shows a side view of the one longitudinal side of the pallet.

Provided on the bottom side of the cellular structure 10 are support members for the pallet. These have the shape of two brackets 36 (see FIG. 2 also), which have a support base plate 38 disposed to rest on a base and three raised portions 40, which are devised to be secured to the underside of the cellular structure 10 onto the lower cover layer or deck 18. The brackets 36 are welded onto the top part to form a unit therewith. Provided between the raised portions of the brackets are openings 44, see FIG. 4, into which it is possible to introduce lifting members for lifting the pallet, such as, for example, the lifting forks (not shown) of a piler truck. The brackets 36 have in the raised portions also draining holes 46, which are in connection with the draining holes 22, 32 in the upper cover 16. It is clear that a corresponding drainage is provided through the cellular structure, e.g. by tubes (not shown) passing therethrough.

Figure 5:
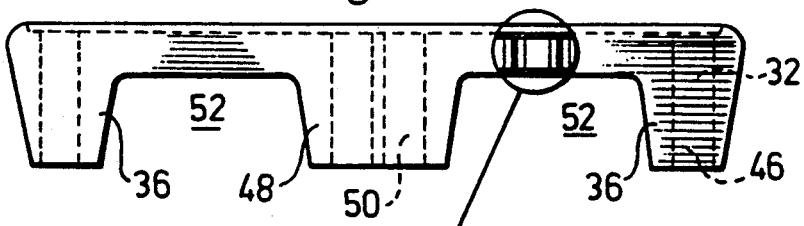
FIG. 5 shows a side view of a short side of the pallet.
Figure 6:
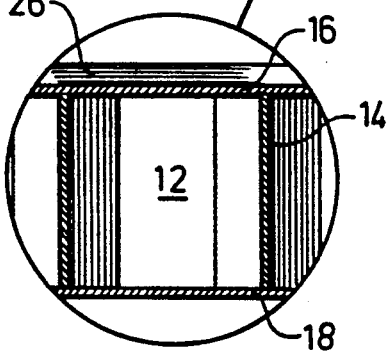
FIG. 6 shows on a larger scale an encircled detail of the pallet of FIG. 5.
Figure 7:
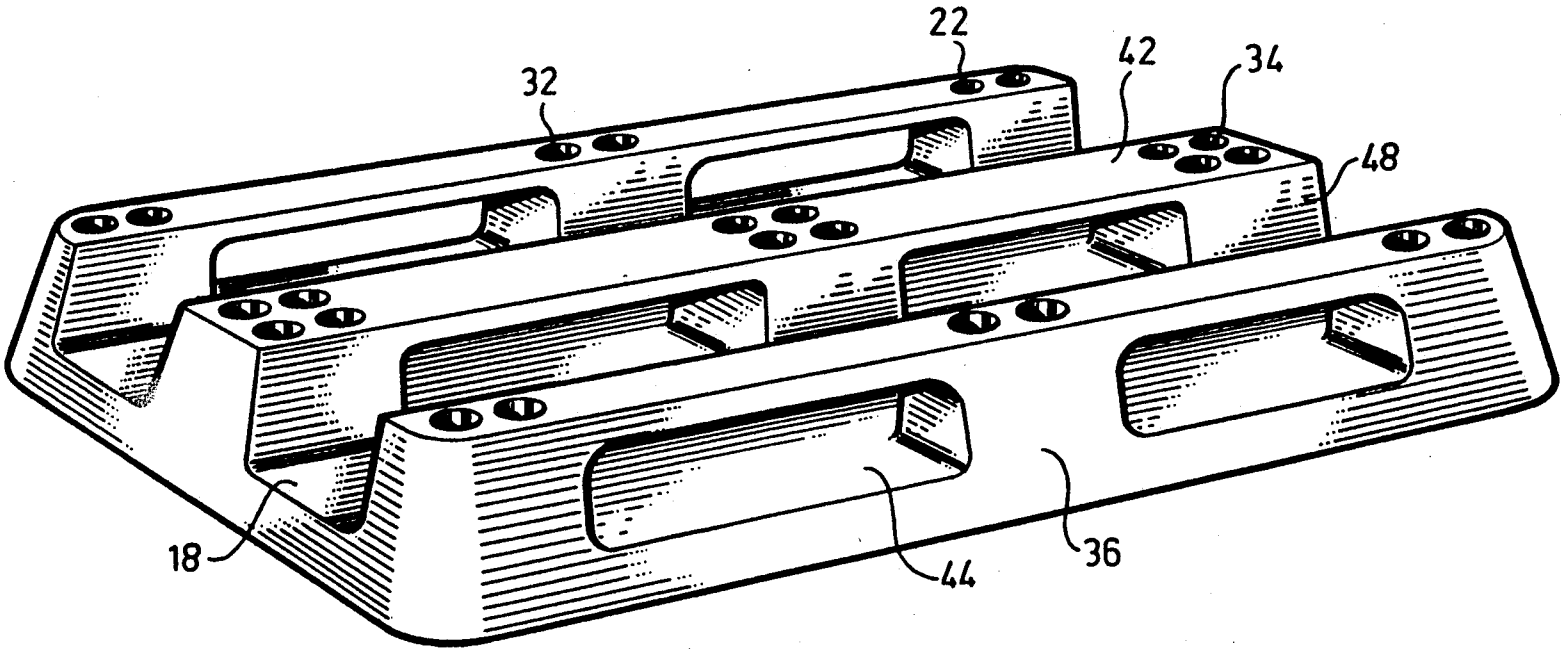
FIG. 7 shows in a perspective view the pallet of FIG. 1 seen from below.

Provided along the short sides of the cellular structure 10 may be additional support members 48 and a support plate 42, which have draining hole 34 and 50 respectively, the last-mentioned connecting through the cellular structure 10, which has been described above, to the holes 34 in the cover 16. Between the brackets 36 and the members 48, there are formed, as is evident from FIG. 5, openings 52 for introduction of lifting members, which have been described above.

It is evident from the preceding description that according to the invention a supporting surface or board or panel with unique properties has been achieved. Owing to the airtightly sealed cells 12 made of an elastic material and joined to a uniform structure 10 the pallet becomes extremely resistant against pressure, shocks and bending forces. Every cell, which is sealed hermetically, functions as controlling and supporting part of the whole panel or cover and still more important as shock absorber and shock damper. Due to the feature that all cells are stayed in each other the pallet obtains its great strength against bending forces while at the same time the encased air cushion provides for necessary resilience in order to avoid cracking of the material. It is obvious that the pallet according to the invention, although described in connection with the use as load carrying surface in a pallet, can be used for other applications also. Thus, it can be used for building up articles such as trays, containers, cupboards, etc., the described structure besides of affording required strength to the article also entailing good insulation thereof.

Obviously, the invention is not limited to the shown embodiment, but may be varied in the widest sense within the scope of the subsequent claims.

We claim:

1. In a load carrying pallet having an interior core of cellular structure including a plurality of cells located adjacent one another the improvement comprising, each pair of adjacent cells having a common side wall, each of said side walls of the cells having upper and lower ends, said upper and lower ends of the cells being covered and hermetically sealed by upper and lower covering layers, respectively, each of said side walls of the cells being elastically deformable so as to yield resiliently when a load is applied thereto but recover its original shape when the load is removed therefrom, and said covered and sealed cells thereby forming a plurality of deformable air chambers which function to absorb and transmit to adjacent cells, shocks and loads directed to said upper and lower covering layers.

2. The load carrying pallet of claim 1 wherein the cells are integrally formed so as to be a homogenous core structure.

3. In a load carrying pallet having an interior core of cellular structure including a plurality of cells located adjacent one another the improvement comprising, each pair of adjacent cells having a common side wall, each of said side walls of the cells being elastically deformable so as to yield resiliently when a load is applied thereto but recovers its original shape when the load is removed therefrom and having upper and lower ends, said upper and lower ends of the cells being covered and hermetically sealed by upper and lower covering layers, respectively, said covered and sealed cells forming a plurality of deformable air chambers which function to absorb and transmit to adjacent cells, shock and loads directed to said upper and lower covering layers, support brackets mounted to said lower covering layer, each of said support brackets extending parallel with respect to one another, a pair of spaced opening in each of said support brackets, each pair of spaced openings of one support bracket being axially aligned with the pair of spaced openings in the other support brackets whereby said support brackets serve to space said lower covering layer from a support surface, a plurality of first drain holes through the core and through said upper and lower covering layers, and each of said support brackets including second drain holes therethrough, said second drain holes communicating with said first drain holes whereby fluid collected along said upper covering layer of the load carrying pallet will be discharged through said second drain holes of said support brackets.

4. In a load carrying composite board having an interior core of cellular structure including a plurality of cells located adjacent one another the improvement comprising, each pair of adjacent cells having a common side wall, each of said side walls of the cells having upper and lower ends, the cells being integrally formed so as to be a homogenous core structure, said upper and lower ends of the core structure being covered with each cell hermetically sealed by upper and lower covering layers, respectively, each of said walls of the cells being elastically deformable so as to yield resiliently when a load is applied thereto but recover its original shape when the load is removed therefrom, and said covered and sealed core structure thereby forming a plurality of deformable air chambers which function to absorb and transmit to adjacent cells, shocks and loads directed to said upper and lower covering layers.

* * * * *